United States Patent [19]

Strauss

[11] 4,034,888

[45] July 12, 1977

[54] CAN FOR CONTAINING BEVERAGES

[76] Inventor: Hubert M. Strauss, 6 Place Notre-Dame, Semur-en-Auxois (Cote d'Or), France

[21] Appl. No.: 641,359

[22] Filed: Dec. 16, 1975

[30] Foreign Application Priority Data

Dec. 17, 1974 France ..... 74.41574

[51] Int. Cl.[2] ..... B65D 41/02

[52] U.S. Cl. ..... 220/260; 220/281; 220/307; 217/110

[58] Field of Search ..... 220/240, 260, 287, 307, 220/DIG. 19; 215/301; 217/110

[56] References Cited

U.S. PATENT DOCUMENTS

| | | | |
|---|---|---|---|
| 3,028,036 | 4/1962 | Goll | 217/110 |
| 3,800,971 | 4/1974 | La Vista | 220/281 |
| 3,910,453 | 10/1975 | Kneusel et al. | 220/260 |

*Primary Examiner*—George T. Hall
*Attorney, Agent, or Firm*—Poms, Smith, Lande & Glenny

[57] ABSTRACT

Metal can for containing a beverage, comprising an end provided, near its edge, with an opening closed by a leakproof capsule retractable to the inside of the can. The opening is extended by a tubular element turned towards the interior of the can and the capsule is made of a semi-deformable rigid material comprising a disc of diameter slightly greater than the diameter of the element and a skirt whose diameter is at most equal to the diameter of the element, the end of the skirt opposite the disc being provided with an external protuberance forming a stop for the capsule against the end of the element.

11 Claims, 2 Drawing Figures

CAN FOR CONTAINING BEVERAGES

The present invention relates to a metal can for containing a beverage provided with a retractable capsule.

At present, beverages are offered for sale to a greater and greater extent in metal cans. These cans are similar to those intended for preserved foods, but with the particular feature of having, on one of their ends, a scored portion to which is fixed a tab which must be pulled to detach the scored portion from the rest of the end and thus make an opening for the liquid to be poured out.

The principal drawback of this disposition resides in the fact that this detachable portion is completely separated, and that, due to its small size, is more readily thrown away anywhere, than the can itself. It therefore constitutes an element of pollution and is also dangerous, because it is very sharp. Finally, due to the importance of the market for these cans, a considerable tonnage of recyclable material is lost.

The invention intends to remedy these drawbacks by proposing a can whose opening system cannot be separated from the can itself.

To this end, the invention relates to a can for containing a beverage, composed of a metallic enclosure, closed by a separate end after it has been filled. According to the invention, this separate end comprises, near its edge, an opening closed by a leakproof capsule retractable to the inside of the can.

In a preferred embodiment of the invention, the above mentioned opening is extended by a cylindrical or substantially elliptic tubular element turned towards the inside of the can and the above-mentioned capsule is made of a semi-deformable rigid material, constituted by a disc of diameter slightly greater than the internal diameter of the above-mentioned tubular element, the disc being securely fixed to a tubular skirt whose external diameter is at most equal to the diameter of said tubular element, whereas the end of the skirt opposite the disc is provided with an external protuberance constituting an abutment for the capsule against the end of the tubular element. Furthermore, the above mentioned orifice is exteriorly lined by an annular depression, with respect to the outer surface of the end, of a depth approximatively equal to the thickness of the disc of the above-mentioned capsule.

Furthermore, in this embodiment, the above-mentioned opening, tubular element and depression are obtained by a stamping and punching operation of the end, the end of the tubular element opposite the orifice is rolled outwardly so as to form an external flange for this element, the skirt of the capsule is so shaped at its end opposite the disc as to envelop the rolled part of the tubular element and to abut on the above-mentioned flange.

Finally, the disc advantageously presents a concavity turned towards the outside of the can.

The invention will be more readily understood on reading the following description given with reference to the attached drawings in which.

Figure 1:
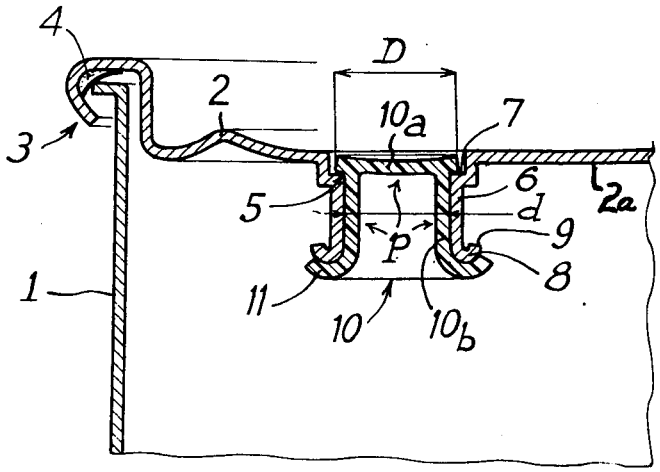
FIG. 1 is a part sectional view of the can according to the invention before the end is fastened.

Referring now to the drawings, FIG. 1 in particular shows a portion of a conventional can comprising a body 1 and an end 2. This end is intended to be crimped onto the body 1 at 3 where a seal 4 is incorporated. The end 2 presents, near its edge, an opening 5 extending inwardly by a tubular element 6 which may be cylindrical or substantially elliptic and a recess 7 in the form of a counterbore surrounding the opening 5. The end is shaped by stamping and punching. The end 8 of the tubular element 6 opposite opening 5 is rolled so as to provide said element 6 with an external flange 9. A capsule 10 made of a semi-deformable rigid material such as a polyvinyl chloride plastics material, is disposed in the opening 5 and inside the tubular element 6. This capsule 10 is composed of an upper part in the form of a disc **10*a* whose thickness is approximately equal to the depth of recess 7** and the external diameter D slightly greater than the inside diameter *d* of the tubular element 6, and of a tubular skirt **10*b*** whose diameter is at most equal to said diameter *d*. The lower part 11 of the skirt **10*b*, opposite disc 10*a*, is shaped as a substantially toric part constituting a protuberance abutting against part 8 of the tubular 6. The disc 10*a*** presents a slight concavity on its outside face.

Figure 2:
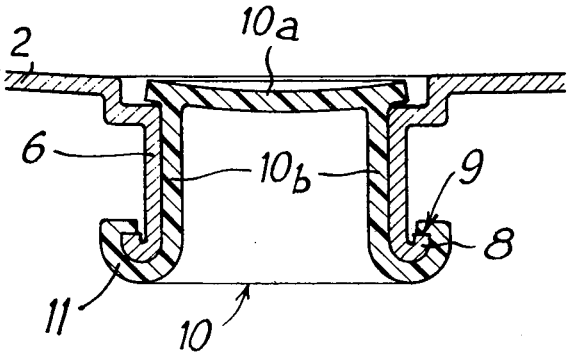
FIG. 2 is a detailed view of a variation embodiment of the invention.

FIG. 2 shows some of the elements of FIG. 1 with the same references. This figure shows a variant embodiment of the capsule in which part 11 thereof is larger and completely envelopes part 8 of the element 6 so as to abut on the previously defined external flange 9.

The positioning of such a capsule must be effected before the can is closed by its end. In fact, it is possible to insert it into element 6 only from the internal face **2*a* of cover 2. This insertion is effected by slight force because the diameter of disc 10*a* is slightly greater than the diameter of the element 6 and the disc must be deformed. The length of the toric part 11 of FIG. 1 is such that it will prohibit it from passing through the tubular element 6**.

Once this positioning is effected, the end 2 is fixed onto the can body 1 by crimping, once the can has been filled with the desired beverage. In the case of this beverage being gaseous, a pressure is established inside the can and in particular at the level of the capsule. This latter, as shown at *p* in FIG. 1, tends to press the capsule which is slightly deformable onto the edges of the tubular element 6, particularly straightening out the concavity of the disc **10*a* and tending to push it towards the outside, this creating an intimate contact between its portion 11 and the rolled portion 8 of the element 6. The more the pressure increases and the more the capsule 10 will tend to lie flat against the walls of the element 6**, the more the seal is ensured.

To open such a can, it is sufficient to exert an effort on disc **10*a* of the capsule by means, for example, of a finger, said effort having to overcome, on the one hand, the force due to the pressure applied on the other face of the disc inside the skirt 10*b* and, on the other hand, the elastic resistance of disc 10*a* during the deformation it must undergo to pass in the tubular element 6. This effort therefore depends on the diameter of the capsule and the difference of the diameters of the disc 10*a* and the tubular element 6. The capsule 10 is thus retracted into the liquid contained in the can, which can then be poured out. Thereafter there is no possibility of the capsule leaving the can by itself through orifice 5**.

In the case of the FIG. 2 variant, the contact of the portion 11 of the skirt **10*b* with the external flange 9 of element 6 offers an extra-secure locking of capsule 10 onto the end 2. This variant is advantageous for cans containing non-gaseous beverages. With respect to this variant, there must be a minimum grip of the capsule on the end so that it will stay in place during the manipulations of the end before being fastened onto the body 1 of the can. This grip is effected by opposite stops formed, on the one hand, by the contact of disc 10***a* with the surface of the recess 7 and the contact of portion 11 of the skirt with portion 8 of the tubular element 6, as shown in FIG. 1. The presence of these opposite stops constitutes further security against untimely strains applied to the capsule. This locking is reinforced in the case of FIG. 2 by the supplementary gripping of portion 11 of the skirt 10*b* on the external flange 9 of element 6. The realisation of this supplementary locking effect constitutes a substitute for the locking effort due to the internal pressure in the can which does not exist with non-gaseous beverages.

In another variant, not shown, the capsule may present an upper disc whose diameter is substantially equal to the diameter of the tubular element 6, the grip being realised only at flange 9 and the portion 11 of the skirt. As a function of the dimensions which may be given to the portion 11 of the skirt gripping on flange 9, the locking effort of the capsule may be varied so as to be adopted for the closure of cans containing carbonated or non-carbonated beverages.

Finally, the can may be provided at the level of the capsule with a protective over-cap, for example disc of adhesive paper protecting against dirt and dust settling on the capusle and also guaranteeing the respect of the integrality of the canned product.

The invention enables a can to be made which can be opened and emptied with one hand, as the simple pressure of a finger can push in the capsule. This action is not dangerous as the finger is never in contact with a sharp surface.

Furthermore, the invention may easily be carried out with the means presently in service on can-filling lines for carbonated beverages. Its adaptation does not present any technical difficulty and, in consequence, does not increase the manufacturing cost of the product. It presents the further advantage of complying simply with the requirements of the legislation in force or future legislation concerning environmental protection.

The invention finds interesting application in the field of beverage-canning.

What is claimed is:

1. A can for containing a beverage, comprising a metallic enclosure closed by a separate end, said end comprising an opening closed by a leakproof capsule retractable to the inside of the can, wherein said opening is formed by a tubular element securely fixed to said end and turned towards the inside of said can, and wherein said capsule is made of a semi-deformable rigid material having a disc of diameter slightly greater than the internal diameter of said tubular element, said disc being securely fixed to a tubular skirt whose external diameter is at most equal to the diameter of said tubular element, the end of said skirt opposite said disc being provided with external protuberance means for gripping said tubular element.

2. A can according to claim 1, wherein said opening is exteriorly lined by an annular depression with respect to the outer surface of said end, of a depth approximately equal to the thickness of said disc.

3. A can according to claim 2, wherein said opening, tubular element and depression are obtained by a stamping and punching operation of said end, herein the end of said tubular element opposite said opening is rolled outwardly so as to form an external flange for said element and wherein said skirt so shaped at its end opposite said disc as to envelope said rolled part and to abut on said flange.

4. A can according to claim 1, wherein said disc presents a concavity turned to the outside of the can.

5. In a can having an end including an opening adapted to be closed by a capsule formed of semi-deformable rigid material, said opening comprising tubular means integral with the can end extending toward the inside of the can about the opening for forming a bore and said capsule means comprising disc means and skirt means integral with said disc means, extending in the same direction as said tubular means, and abutting said tubular means, the improvement comprising the provision of:

said disc means having a diameter greater than the opening and being deformable for passing into the opening, whereby deformation of the semi-deformable rigid material of the disc allows the disc to be forced through the opening to expose the inside of the can.

6. The improvement of claim 5 further comprising a portion of greater diameter than the opening between the end of the can and the opening for forming an external annular depression for receiving the portion of the disc extending beyond the opening.

7. The improvement of claim 6 wherein said annular depression has an annular width and said disc extends beyond the outside of the skirt means a distance substantially equal to the annular width of the annular depression.

8. In a can having an end including an opening adapted to be closed by a capsule formed of semi-deformable rigid material, said opening comprising tubular means integral with the can end extending toward the inside of the can about the opening for forming a bore and said capsule means comprising disc means and skirt means integral with said disc means, extending in the same direction as said tubular means, and abutting said tubular means, the improvement comprising the provision of:

said skirt means and said tubular means both being generally perpendicular to the end of the can.

9. In a can having an end including an opening adapted to be closed by a capsule formed of semi-deformable rigid material, said opening comprising tubular means integral with the can end extending toward the inside of the can about the opening for forming a bore and said capsule means comprising disc means and skirt means integral with said disc means, extending in the same direction as said tubular means, and abutting said tubular means, the improvement comprising the provision of:

said tubular means terminating in a lip facing the end of the can, said skirt means having contacting means extending adjacent said lip between the lip and the end of the can for holding the capsule in the opening.

10. The improvement of claim 5 wherein the disc is concave relative to the outside of the can.

11. The improvement of claim 6 wherein said exterior annular depression has a thickness substantially equal to the thickness of the disc.

* * * * *